US008376356B2

(12) United States Patent
Gentle et al.

(10) Patent No.: US 8,376,356 B2
(45) Date of Patent: Feb. 19, 2013

(54) INFINITELY VARIABLE FORMAT SIGNATURE COLLECTION APPARATUS AND METHOD OF COLLECTING SIGNATURES

(75) Inventors: Brian Joseph Gentle, Rochester, NH (US); Barry Mark Jackson, York, ME (US)

(73) Assignee: Goss International Americas, Inc., Durham, NH (US)

( * ) Notice: Subject to any disclaimer, the term of this patent is extended or adjusted under 35 U.S.C. 154(b) by 390 days.

(21) Appl. No.: 12/563,763

(22) Filed: Sep. 21, 2009

(65) Prior Publication Data

US 2011/0068531 A1 Mar. 24, 2011

(51) Int. Cl.
*B65H 5/12* (2006.01)

(52) U.S. Cl. ..... 271/204; 271/206; 271/275; 271/277

(58) Field of Classification Search ..... 271/275, 271/277, 198, 204, 206, 202
See application file for complete search history.

(56) References Cited

U.S. PATENT DOCUMENTS 3,807,287 A 4/1974 Plagata et al. ..... 93/8 WA
4,799,664 A * 1/1989 Burger ..... 271/277
5,431,386 A * 7/1995 Blaser ..... 271/204
6,129,350 A 10/2000 St. Ours
6,478,297 B1 * 11/2002 Messerschmid ..... 271/277
6,547,297 B2 4/2003 Cote et al.
6,631,901 B2 * 10/2003 Hess et al. ..... 271/205
7,048,110 B2 5/2006 Hachiya et al. ..... 198/470.1
7,198,267 B2 * 4/2007 Forch et al. ..... 271/204
7,232,123 B2 6/2007 Foerch et al.
7,261,291 B2 * 8/2007 Forch et al. ..... 271/183
7,594,658 B2 * 9/2009 Mutschall et al. ..... 271/277
7,641,195 B2 * 1/2010 Suzuki ..... 271/307
2002/0060409 A1 * 5/2002 Hess et al. ..... 271/198
2004/0113350 A1 * 6/2004 Forch et al. ..... 271/69

* cited by examiner

*Primary Examiner* — Kaitlin Joerger

(74) *Attorney, Agent, or Firm* — Davidson, Davidson & Kappel, LLC

(57) ABSTRACT

A variable format signature collection apparatus is provided. The variable format signature collection apparatus includes a sprocket and a timing belt traveling about the sprocket. The timing belt includes a plurality of gripper mounts. The gripper mounts include a first set of gripper mounts arranged on the timing belt to support grippers for receiving first signatures of a first cutoff length and a second set of gripper mounts positioned to support grippers for receiving second signatures of a second cutoff length.

17 Claims, 5 Drawing Sheets

INFINITELY VARIABLE FORMAT SIGNATURE COLLECTION APPARATUS AND METHOD OF COLLECTING SIGNATURES

The present invention relates generally to folders of printing presses and more specifically to a variable format signature collection apparatuses.

BACKGROUND OF INVENTION

U.S. Pat. No. 6,129,350, which is hereby incorporated by reference, discloses a timing belt formed with a tensile member and a plurality of teeth which mesh with a sprocket wheel. One or more of the teeth are formed with an opening and a product processing device is mounted on the timing belt and attached via the opening in the tooth. The timing belt is preferably an endless belt and the teeth define an inner running surface. Grippers or similar product processing devices may be mounted on the belt so as to be pivotable about an axis through the openings in the teeth.

U.S. Pat. No. 6,547,297, which is hereby incorporated by reference, discloses a gripper assembly for a deceleration/acceleration drum which includes a pivot arm with a gripper seat and a gripper bar with a gripper and a pin assembly. The assembly further includes a first toggle link supported by the pivot arm about a first pivot points the gripper bar is able to partially rotate about the first toggle link about a second pivot point. The assembly also includes a second toggle link supported by the pivot arm which supports the pin assembly of the gripper bar.

U.S. Pat. No. 7,232,123 discloses an apparatus for conveying sheets from a printing machine to a stack having at least one gripper bar carrying one or more grippers which, during the conveyance, holds a sheet at its edge between a gripper finger and a gripper pad. Endless chains move the gripper bar on a path between a cylinder belonging to the machine and the stack. An actuating mechanism opens and closes the gripper as a sheet is picked up from the cylinder and as it is allowed to fall onto the stack. In the opened state, the gripper finger is located below a path described by the upper edge of the gripper pad.

BRIEF SUMMARY OF THE INVENTION

A variable format signature collection apparatus is provided. The variable format signature collection apparatus includes a sprocket and a timing belt traveling about the sprocket. The timing belt includes a plurality of gripper mounts. The gripper mounts include a first set of gripper mounts arranged on the timing belt to support grippers for receiving first signatures of a first cutoff length and a second set of gripper mounts positioned to support grippers for receiving second signatures of a second cutoff length.

A method of collecting signatures of variable cutoff length in a printing press is also provided. The method includes the steps of providing a plurality of grippers; arranging a first set of grippers from the plurality of grippers on a timing belt so that the first set of grippers are evenly spaced in a first arrangement about the timing belt; gripping first signatures of a first cutoff length with the first set of grippers spaced in the first arrangement; arranging a second set of grippers from the plurality of grippers on the timing belt so that the second set of grippers are evenly spaced in a second arrangement about the timing belt; and gripping second signatures of a second cutoff length with the second set of grippers spaced in the second arrangement.

BRIEF DESCRIPTION OF THE DRAWINGS

The present invention is described below by reference to the following drawings, in which.

DETAILED DESCRIPTION

In a printing press, printing units print images on a web and the web may be longitudinally slit into ribbons. Signatures may be created from the web or ribbons, by cutting the web or ribbons at repeating lengths. The signatures may then be transported in a folder, where a set of pins or grippers clasp a lead edge of each signature against a collect cylinder. In order for grippers to receive signatures a gap may be introduced between successive signatures. The gap allows grippers to be actuated to grip signatures without sweeping through the signatures. Grippers may be cam actuated and equally spaced about the collect cylinder.

In order to achieve the gap, the collect cylinder may be rotating so that a velocity of the grippers exceeds a velocity that the signatures are traveling before each signature is gripped by a gripper. The velocity that the signatures are traveling before each signature is gripped by a gripper may equal a velocity of the web. Thus, grippers may have a velocity gain with respect to the web. If the printing press is adjusted to change a length of the signatures received by the collect cylinder, a change in the velocity gain may be needed to ensure that grippers on the collect cylinder are in a proper position to receive signatures of the new length. However, the signature length cannot be greater than the existing spacing between the grippers on the collect cylinder. Also, the signature length cannot be excessively less as the required velocity gain may exceed the allowable loads of the downstream operations. For example, if grippers are separated by eleven inches, grippers gripping five and one half inch signatures need to travel at twice the velocity of the web so that signatures may be consecutively gripped by evenly spaced grippers. Also, for example, if grippers are separated by twenty-two inches, grippers gripping five and one half inch signatures need to travel at four times the velocity of the web so that signatures may be consecutively gripped by evenly spaced grippers.

The grippers on collection cylinders may be mounted to arms equally spaced about the collection cylinder. In such an arrangement, adding additional grippers requires adding additional arms to the collection cylinder. Also, the existing arms may need to be pivotable to allow the added arms and the existing arms to be equally spaced. Furthermore, to facilitate a surface for the signatures to rest while being gripped, the collection cylinder may require cover pieces that may telescope or cover pieces that may be easily swapped with cover pieces of shorter or longer length when signature length is changed.

Figure 1:
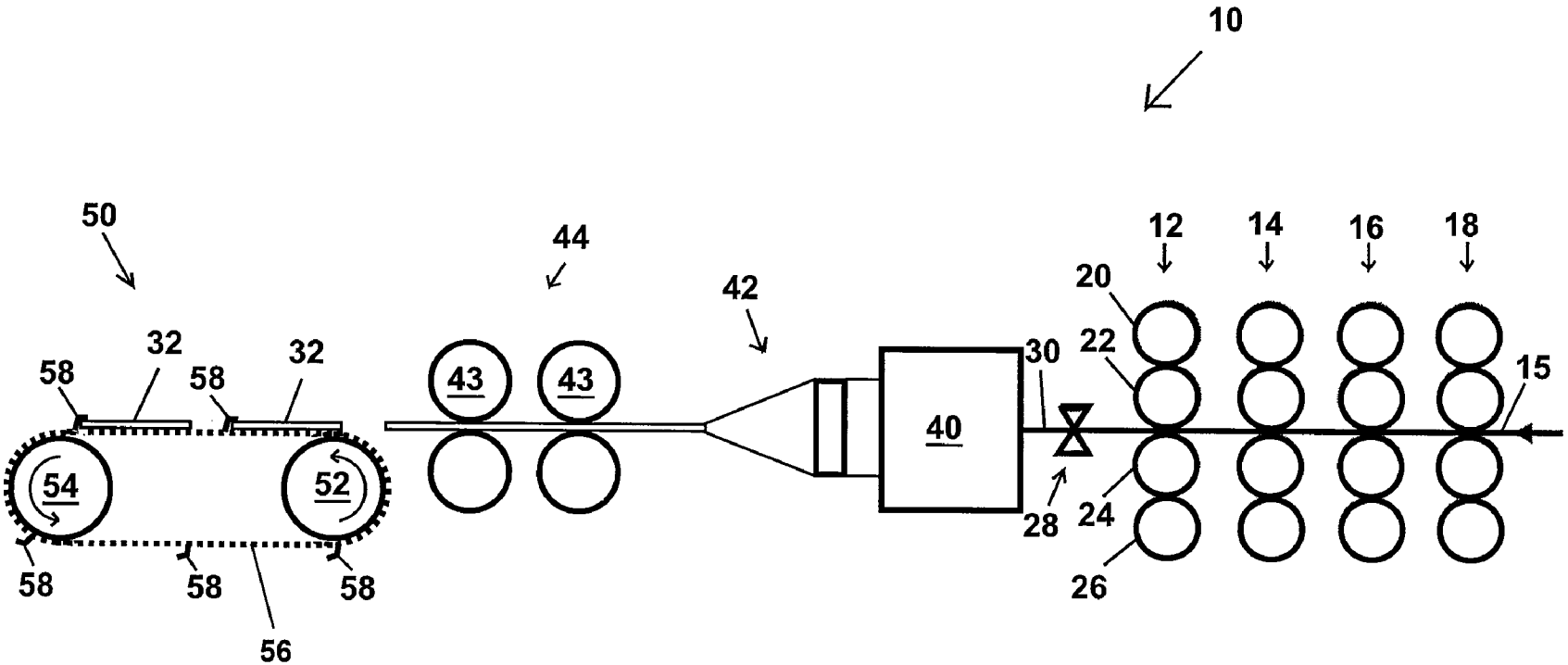
FIG. 1 shows a schematic side view of a variable cutoff printing press including a signature collection apparatus according to an embodiment of the present invention.

FIG. 1 shows a schematic side view of a variable cutoff printing press 10 including a signature collection apparatus 50 according to an embodiment of the present invention. Printing units 12, 14, 16, 18 print four color images on a web 15. Each printing unit 12, 14, 16, 18 includes an upper plate cylinder 20, an upper blanket cylinder 22, a lower blanket cylinder 24 and a lower plate cylinder 26. After images are printed on web 15, web 15 passes through a slitter 28, which longitudinally slits web 15 into a plurality of ribbons 30. A web guiding assembly 40 then turns and offsets ribbons 30 so ribbons 30 are properly aligned as ribbons 30 enter a former section 42. Former section 42 imparts a longitudinal fold upon ribbons 30.

Once longitudinally folded, ribbons 30 are cut by a variable format cutting assembly 44, which includes cutting cylinders 43, into signatures 32. Signatures 32 are transported away from cutting assembly 44 by signature collection apparatus 50. Signature collection apparatus 50 includes a first sprocket 52, a second sprocket 54 and a timing belt 56 traveling in a path around sprockets 52, 54. Sprockets 52, 54 and timing belt 56 may include teeth, with teeth of sprockets 52, 54 interacting with teeth of timing belt. Grippers 58 are connected to timing belt 56 to transport signatures 32. Lead edges of signatures 32 are gripped by grippers 58 and tail edges of signatures may be supported by timing belt 56.

Signature collection apparatus 50 may transport signatures of varying lengths. For example, signatures 32 may be a first length. Grippers 58 that receive signatures 32 may be removed from timing belt 56 when printing press 10 undergoes a format change, from creating signatures 32 of the first length to creating signatures of a second length. Grippers 58 may then be attached to different locations on timing belt 56 to allow signature collection apparatus 60 to transport the signatures of the second length. The number of grippers 58 attached to timing belt 56 may depend on the length of the signatures signature collection apparatus 50 transports. For longer signatures, less grippers 58 may be necessary, while for shorter signatures, more grippers 58 may be necessary. Grippers 58 may remain in the same locations on belt 56 for smaller changes in signature length, while only a velocity at which timing belt 56 is translated is changed.

Figure 2:
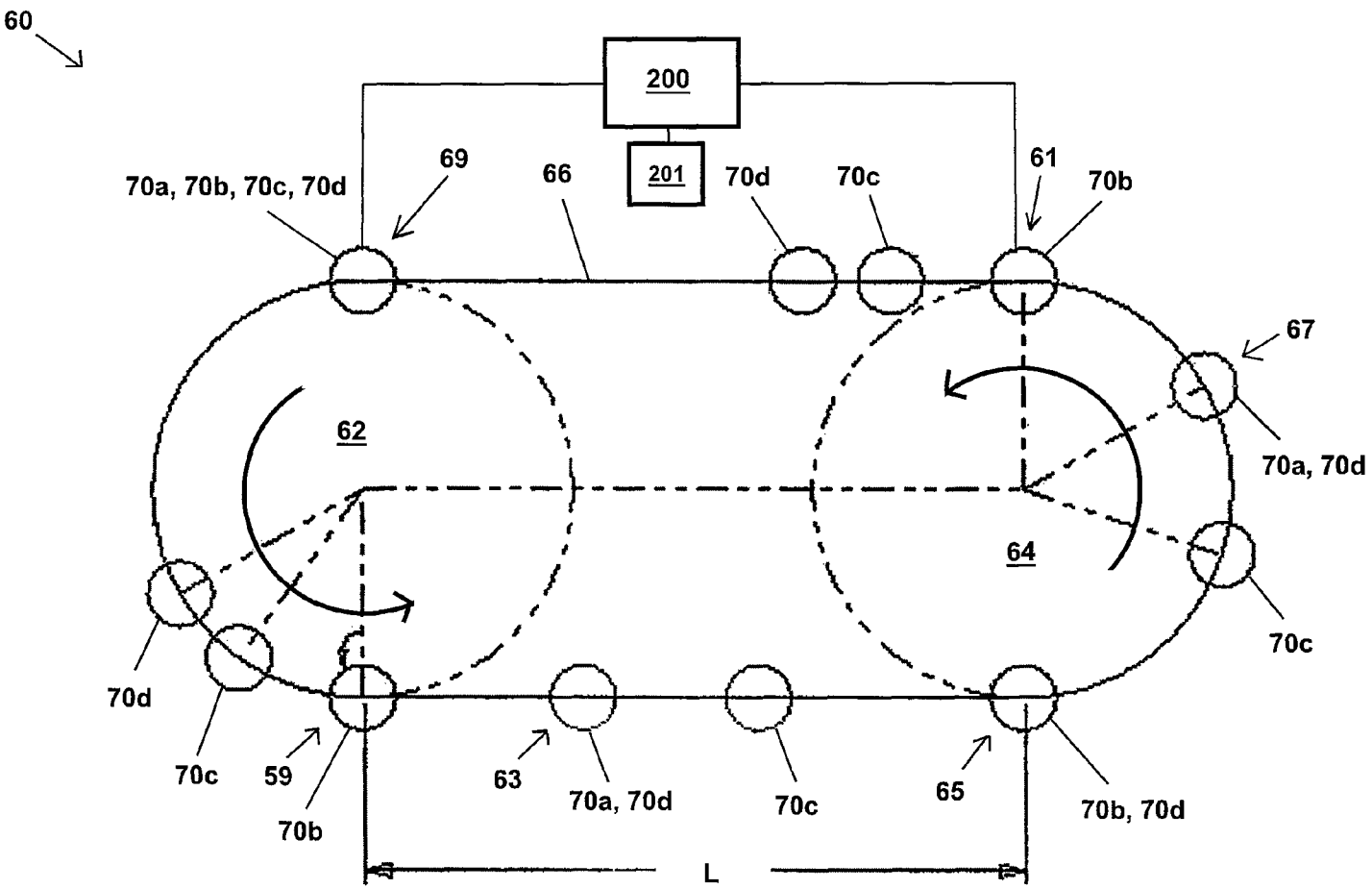
FIG. 2 shows a schematic side view of a signature collection apparatus according to an embodiment of the present invention.

FIG. 2 shows a schematic side view of a signature collection apparatus 60 according to an embodiment of the present invention. Signature collection apparatus 60 includes a first sprocket 62, a second sprocket 64 and a timing belt 66 traveling in a path around sprockets 62, 64 as sprockets 62, 64 rotate. Sprockets 62, 64 may include teeth that interact with teeth on an inside surface of timing belt 66 to translate timing belt 66. A motor 200 controlled by a controller 201 may rotate sprockets 62, 64 to translate timing belt 66 at desired velocities. Signature collection apparatus 60 is arranged to receive and transport signatures of various cutoffs. Grippers, such as grippers 58 shown in FIG. 1, may be mounted at evenly spaced intervals on timing belt 66 at various positions to securely grip signatures for transport by signature collection apparatus 60 as timing belt 66 and the attached grippers travel in a path around sprockets 62, 64.

The spacing in between the grippers on timing belt 66 corresponds to a range of signatures that may be gripped by the grippers in the particular gripper spacing arrangement. In order to prevent signature overlapping and also to create a gap that allows the grippers to grip a lead edge of a signature without contacting a tail edge of an adjacent signature, the grippers may be spaced at intervals that are greater than the length of the signatures being gripped. Also, the length of signatures that a particular gripper spacing arrangement may receive may be limited by the velocity the grippers have to travel for consecutive grippers to grip consecutive signatures. If the space in between consecutive grippers is too large in relation to the length of signatures the grippers are receiving, the velocity that the grippers travel may be too great and may disrupt downstream finishing operations.

In order to allow signature collection apparatus 60 to grip signatures of different lengths without causing gripping problems or disrupting downstream finishing operations, timing belt 66 is configured to support multiple gripper spacing arrangements by including four sets of gripper mounts 70*a*, 70*b*, 70*c*, 70*d*. Gripper mounts 70*a*, 70*b*, 70*c*, 70*d* provide flexibility to allow signature collection apparatus 60 to receive signatures of different lengths, with each set of gripper mounts 70*a*, 70*b*, 70*c*, 70*d* able to support grippers that may receive signatures of multiple cutoff lengths. Thus, when signatures to be delivered to signature collection apparatus 60 fall outside of a length signatures that may be properly handled by a particular gripper spacing arrangement, grippers may be mounted on whichever grippers mounts 70*a*, 70*b*, 70*c*, 70*d* are spaced to properly handle the signatures to be delivered to signature collection apparatus 60.

In a preferred embodiment, gripper mounts 70*a*, 70*b*, 70*c*, 70*d* are located on teeth of, or a pitch spacing of, timing belt 66. Each set of gripper mounts 70*a*, 70*b*, 70*c*, 70*d* are evenly spaced about timing belt 66. During operation of signature collection apparatus 60, grippers on one set of gripper mounts 70*a*, 70*b*, 70*c*, 70*d* receive signatures of a particular cutoff length. Three evenly spaced grippers may be attached on timing belt 66 at mounts 70*a*, four evenly spaced grippers may be attached on timing belt 66 at mounts 70*b*, five evenly spaced grippers may be attached on timing belt 66 at mounts 70*c* and six evenly spaced grippers may be attached on timing belt 66 at mounts 70*d*. In other embodiments, more gripper mounts may be present and timing belt 66 may accommodate more than six evenly spaced grippers in a spacing arrangement.

Timing belt 66 may have a belt tooth pitch spacing that is based on a common denominator. The common denominator may be a multiple of the integers 2, 3, 4, 5 and 6. For example, a value of 300 is one common denominator of 2, 3, 4, 5 and 6. Thus, belt 66 may have 300 teeth and thus 2, 3, 4, 5 or 6 grippers may be evenly spaced about timing belt on teeth of timing belt 66.

In one exemplary embodiment, timing belt 66 may include 120 teeth and have a belt pitch length of 1200 mm, with teeth being spaced at 10 mm (belt pitch). Centers of sprockets 62, 64 may be separated by a distance X equal to 300 mm and sprockets 62, 64 may each have a circumference of 600 mm. Thus, grippers may be placed about the perimeter of timing belt 66 at three gripper mounts 70*a*, each gripper mount 70*a* being spaced apart by 40 teeth and 400 mm; grippers may be placed about a perimeter of timing belt 66 at four gripper mounts 70*b*, each gripper mount 70*b* being spaced apart by 30 teeth and 300 mm; grippers may be placed about a perimeter of timing belt 66 at five gripper mounts 70*c*, each gripper mount 70*c* being spaced apart by 24 teeth and 240 mm; and grippers may also be placed about a perimeter of timing belt 66 at six gripper mounts 70*d*, each gripper mount being spaced apart by 20 teeth and 200 mm.

Gripper mounts 70*a*, 70*b*, 70*c*, 70*d* or certain combinations thereof may be one in the same at certain locations on timing belt 66, as shown in FIG. 2 at location 69, for example. Thus, total gripper mounts may be minimized and not all grippers may need to be removed when grippers are changed due to a change in signature cutoff length. As shown in FIG. 2, gripper mount coincidence at certain locations allows the total number of mounting positions to be decreased from eighteen (three mounts 70*a*, four mounts 70*b*, five mounts 70*c*, six mounts 70*d*) to twelve (one location 69 shared by mounts 70*a*, 70*b*, 70*c*, 70*d*; two locations 67, 65 shared by mounts 70*a*, 70*d*; one location 63 shared by mounts; two other mounts 70*d*; four other mounts 70*c*; and two other mounts 70*b*). For example, if signature collection apparatus 60 is receiving signatures of a first cutoff length with four grippers mounted on timing belt 66 at mounts 70*b* and is to be modified to receive signatures of a second cutoff length which requires mounting six grippers at mounts 70*d*, grippers may be left in place in gripper mounts 70*b* at locations 65, 69, but removed at locations 59, 61. Grippers then only need to be mounted on the four remaining mounts 70*d* to complete the gripper format change.

An ability to space grippers about timing belt 66 on different gripper mounts 70*a*, 70*b*, 70*c*, 70*d* allows signature collection apparatus 60 to advantageously handle printed products of a wide range of lengths. In order for signature collection apparatus 60 to accept signatures of a particular length, grippers may be installed on one set of gripper mounts 70*a*, 70*b*, 70*c*, 70*d* and a velocity at which timing belt 66 travels about the sprockets 62, 64 may be accordingly set. The velocity of timing belt 66 may be set to create a gap in between signatures gripped by signature collection apparatus 60 in order for the grippers to properly receive the signatures.

For gripper mounts 70*a*, 70*b*, 70*c*, 70*d* on a 1200 mm timing belt 66, signatures may be received by signature collection apparatus 60 that are between approximately 15.33 inches (≈389 mm) and 11.38 inches (≈289 mm) in length when grippers are on gripper mounts 70*a*, between approximately 11.38 inches (≈289 mm) and 9 inches (≈229 mm) in length when grippers are on gripper mounts 70*b*, between approximately 9 inches (≈229 mm) and 7.44 inches (≈189 mm) in length when grippers are on gripper mounts 70*c* and between approximately 7.44 inches (≈189 mm) and 4.50 inches (≈114 mm) in length when grippers are on gripper mounts 70*d*.

An operator of signature collection apparatus 60 may switch from one gripper spacing arrangement to another gripper spacing arrangement based on the cutoff length of images printed by upstream printing units. For example, as shown in FIG. 1, printing press 10 includes four printing units 12, 14, 16, 18, each including two plate cylinders 20, 26 and two blanket cylinders 22, 24. If plate cylinders 20, 26 are 44 inches in circumference, printing press 10 may print the following signatures for each revolution of plate cylinders 20, 26: three signatures approximately 14.67 inches (≈373 mm) in length, four signatures approximately 11 inches (≈279 mm) in length, five signatures approximately 8.8 inches (≈224 mm) in length and six signatures approximately 7.33 inches (≈186 mm) in length. Grippers may be attached at gripper mounts 70*a* to accommodate the 14.67 inch signatures, grippers may be attached at gripper mounts 70*b* to accommodate the 11 inch signatures, grippers may be attached at gripper mounts 70*c* to accommodate the 8.8 inch signatures and grippers may be attached at gripper mounts 70*d* to accommodate the 7.33 inch signatures.

Grippers may be removably mounted to timing belt 66 on gripper mounts 70*a*, 70*b*, 70*c*, 70*d* or grippers may be attached on timing belt 66 at gripper mounts 70*a*, 70*b*, 70*c*, 70*d* in such a manner that the grippers not in use for a particular group of signatures may be pivoted out of gripping positions and kept from interfering with signatures being received by grippers that are in use.

In an alternative embodiment, grippers for each gripper spacing arrangement may be welded onto separate timing belts so that grippers are mounted on gripper mounts 70*a* on a first timing belt, grippers are mounted on gripper mounts 70*b* on a second timing belt, grippers are mounted on gripper mounts 70*c* on a third timing belt and grippers are mounted on gripper mounts 70*d* on a fourth timing belt. The timing belt having grippers located at the particular positions 70*a*, 70*b*, 70*c*, 70*d* which correspond to the signature length will then be mounted on sprockets 62, 64. When signature length changes, the timing belt mounted on sprockets 62, 64 may be removed and replaced with a timing belt corresponding to the new signature length.

Signature collection apparatus 60 may be configured so that grippers release signatures to a dedicated stream, required for a dedicated fold or a delivery. A release point that grippers release signatures can be anywhere about the perimeter of signature collection apparatus 60 and is not restricted to a particular location. For example, the release point for grippers at positions 70*a* may be different from the release point for grippers at positions 70*b*. Grippers may release signatures to a dedicated delivery fan for different signature lengths or to a downstream operation creating a cross fold.

In alternative embodiments of the present invention, signature collection apparatus 60 may include more than two sprockets. For example, three sprockets may be employed, with timing belt 66 traveling about the sprockets in a triangular loop.

In another alternative embodiment of the present invention, signature collection apparatus 60 may include only a single sprocket, with timing belt 66 traveling about the single sprocket.

Figure 3:
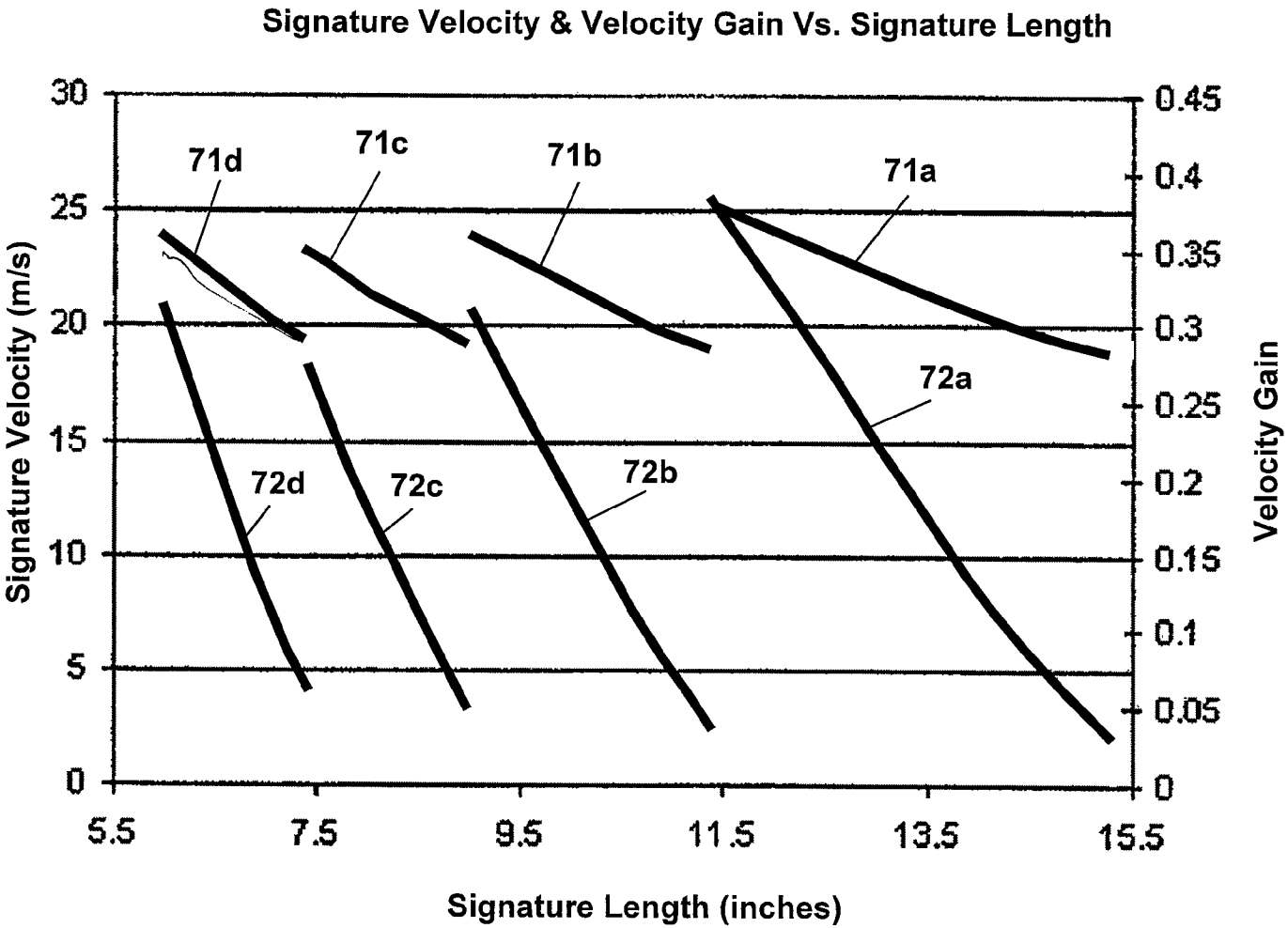
FIG. 3 shows a graph of predicted values for signature velocity and velocity gain versus signature length for four exemplary gripper spacing arrangements of the embodiment shown in FIG. 2.

FIG. 3 shows a graph of predicted values for signature velocity and velocity gain versus signature length for the four exemplary gripper spacing arrangements of the embodiment shown in FIG. 2. Velocity gain is a percentage increase (represented as a decimal) of the velocity of the signatures from a point just before the signatures are gripper by the grippers, which substantially equals a velocity of the web, to a point where the signatures reach a velocity of the grippers. The velocity gain is shown in relation to a base web velocity of 18.288 meters per second.

Line 71*d* represents a relationship between gripped signature velocity and signature length for signatures between approximately 6 inches and 7.44 inches in length and are gripped by grippers at to mounts 70*d* separated by 200 mm on timing belt 66 (FIG. 2). Line 72*d* represents a relationship between velocity gain and signature length for the same signatures.

Line 71*c* represents a relationship between gripped signature velocity and signature length for signatures between approximately 7.44 inches and 9 inches in length and are gripped by grippers at to mounts 70*d* separated by 240 mm on timing belt 66 (FIG. 2). Line 72*c* represents a relationship between velocity gain and signature length for the same signatures.

Line 71*b* represents a relationship between gripped signature velocity and signature length for signatures between approximately 9 inches and 11.38 inches in length and are gripped by grippers at to mounts 70*d* separated by 300 mm on timing belt 66 (FIG. 2). Line 72*b* represents a relationship between velocity gain and signature length for the same signatures.

Line 71*d* represents a relationship between gripped signature velocity and signature length for signatures between approximately 11.38 inches and 15.33 inches in length and are gripped by grippers at to mounts 70*d* separated by 400 mm on timing belt 66 (FIG. 2). Line 72*a* represents a relationship between velocity gain and signature length for the same signatures.

Figure 4:
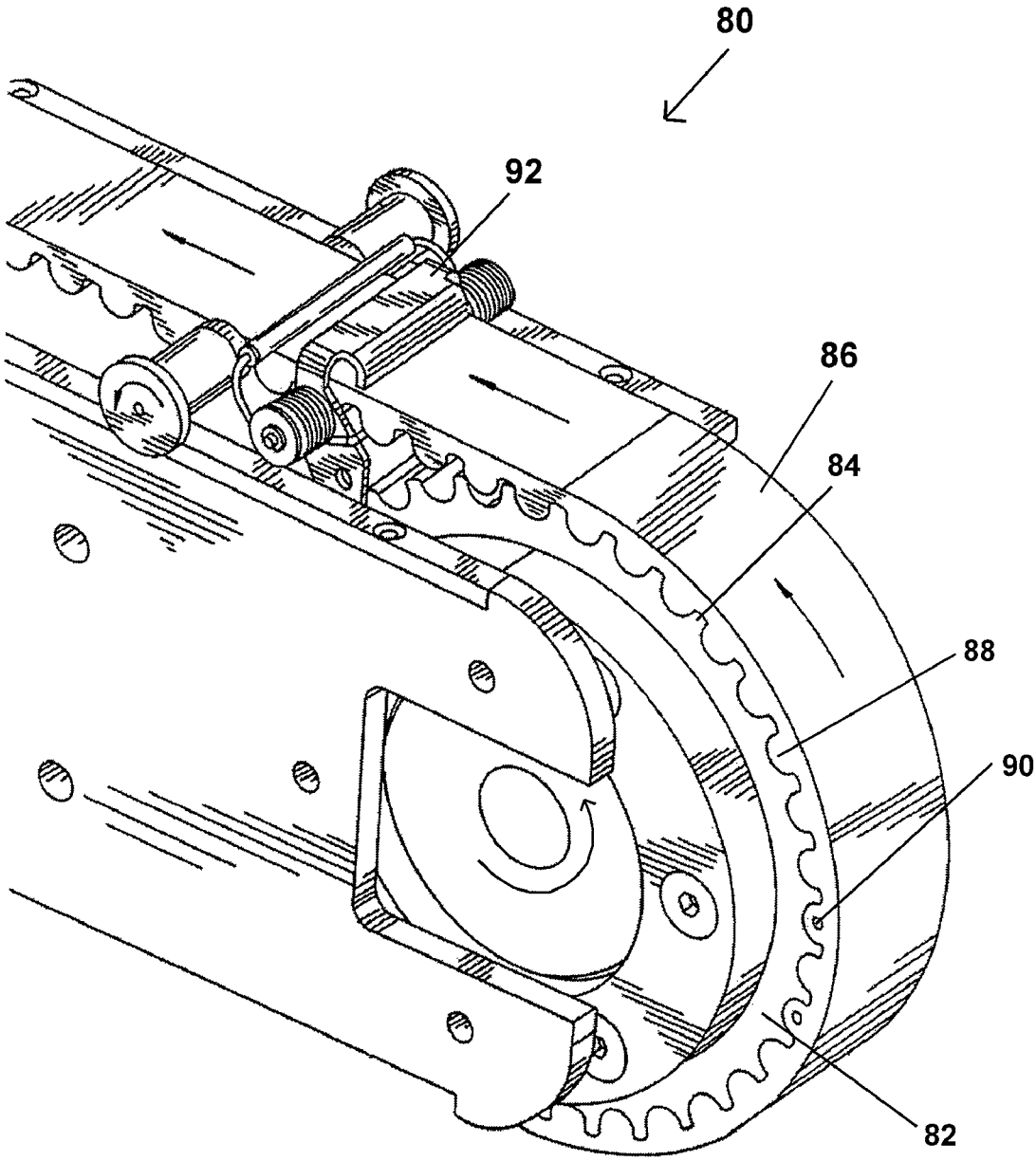
FIG. 4 shows a partial perspective view of a signature collection apparatus according to an embodiment of the present invention.

FIG. 4 shows a partial perspective view of a signature collection apparatus 80 according to an embodiment of the present invention. A timing belt 86 is translated by a sprocket 82 via rotation of sprocket 82. Belt teeth 88 interact with sprocket teeth 84 to prevent slipping during operation. In this embodiment timing belt 86 includes perforations 90 in belt teeth 88 that act as gripper mounts. Multiple perforations 90 are provided in timing belt 86 to allow an operator to removably mount grippers 92 on timing belt 86 at desired intervals. When a cutoff length of signatures received by signature collection apparatus 80 is varied, the operator may remove grippers 92 from certain perforations 90 and install grippers 92 in other perforations 90 that allow signature collection apparatus 80 to properly receive the signatures to be received. The operator may also adjust the velocity at which timing belt 86 is translated so that evenly spaced grippers 92 are in proper positions to receive signatures.

Figure 5:
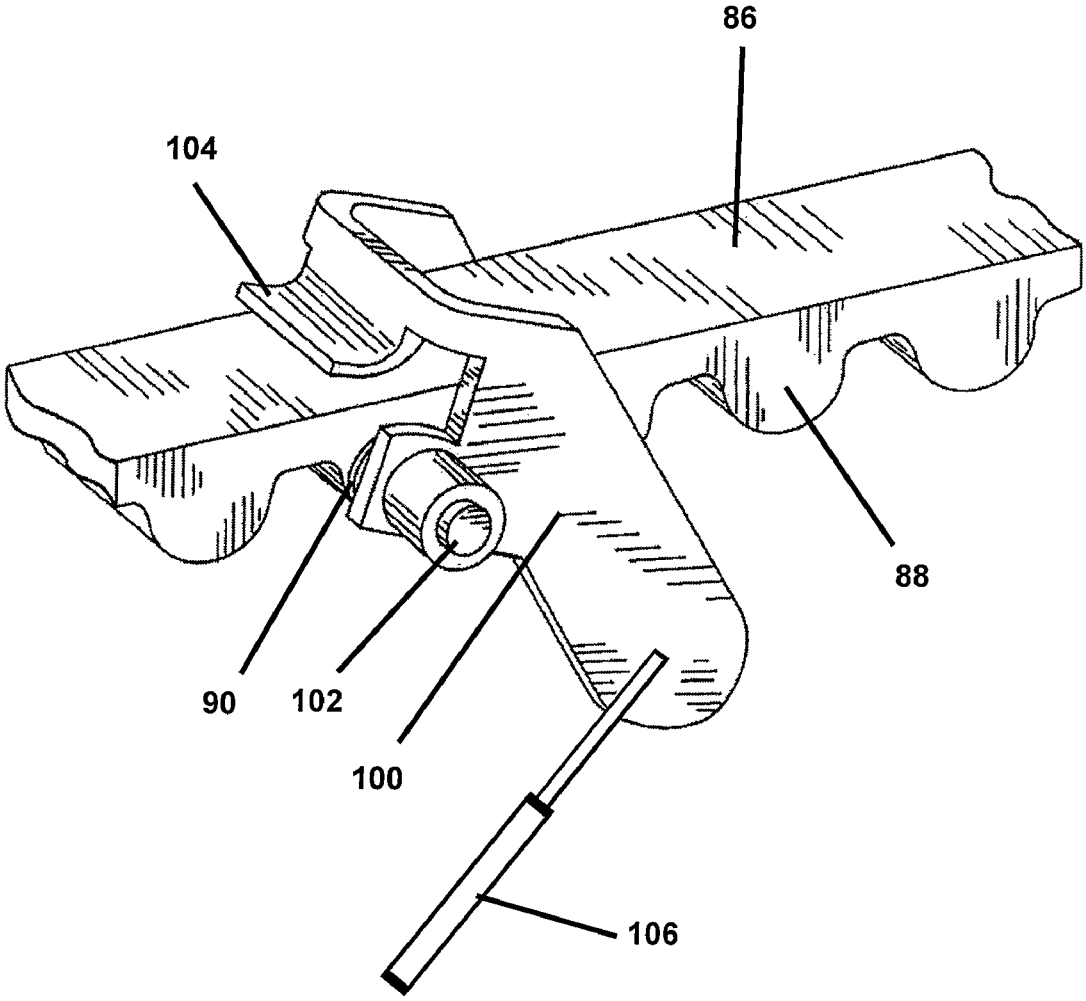
FIG. 5 shows a schematic perspective view of a section of a timing belt with a gripper pivotally mounted on the timing belt.

FIG. 5 shows a schematic perspective view of a section of timing belt 86 with a gripper 100 pivotally mounted on timing belt 86. Gripper 100 is removably attached to one tooth 88 of timing belt 86 via a fastener 102, which passes through gripper 100 and perforation 90 of timing belt 86. In order to grip a signature, an actuator 106 pivots gripper 100 about fastener 102, causing a tip 104 of gripper 100 to hold the signature against timing belt 86. To release the signature, actuator 106 causes tip 104 to move away from timing belt 86.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable format signature collection apparatus comprising:

a sprocket;

a timing belt traveling about the sprocket, the timing belt including a plurality of gripper mounts, the gripper mounts including a first set of gripper mounts arranged on the timing belt to support grippers for receiving first signatures of a first cutoff length and a second set of gripper mounts positioned to support grippers for receiving second signatures of a second cutoff length; and a controller, the controller controlling a velocity of the timing belt as a function of the first or second cutoff length.

2. The variable format signature collection apparatus recited in claim 1 further comprising a motor rotating the first and second sprockets, the motor capable of rotating the first and second sprockets at a first velocity for receiving the first signatures and at a second velocity for receiving the second signatures.

3. The variable format signature collection apparatus recited in claim 1 wherein the gripper mounts comprise perforations in the timing belt, the perforations configured to support grippers.

4. The variable format signature collection apparatus recited in claim 1 further comprising a plurality of first grippers, each of the plurality of first grippers being mounted on a corresponding gripper mount of the first set of gripper mounts, the first grippers mounted on the timing belt such that the first grippers are evenly spaced about the timing belt.

5. The variable format signature collection apparatus recited in claim 4 wherein the first grippers transport the first signatures by gripping a leading edge of each of the first signatures and the timing belt supports a portion of each first signature during transport.

6. The variable format signature collection apparatus recited in claim 5 further comprising a controller controlling a velocity that the timing belt travels about the sprocket as a function of a relationship between a length of timing belt between each of the first grippers and the first cutoff length.

7. A variable format signature collection apparatus comprising:

a sprocket; and a timing belt traveling about the sprocket, the timing belt including a plurality of gripper mounts, the gripper mounts including a first set of gripper mounts arranged on the timing belt to support grippers for receiving first signatures of a first cutoff length and a second set of gripper mounts positioned to support grippers for receiving of a second cutoff length, wherein at least one of the gripper mounts of the first set of gripper mounts is one of the gripper mounts of the second set of gripper mounts.

8. A variable format signature collection apparatus comprising:

a sprocket; and a timing belt traveling about the sprocket, the timing belt including a plurality of gripper mounts. the gripper mounts including a first set of gripper mounts arranged on the timing belt to support grippers for receiving first signatures of a first cutoff length and a second set of gripper mounts positioned to support grippers for receiving second signatures of a second cutoff length, wherein at least one of the gripper mounts of the first set of gripper mounts is not one of the gripper mounts of the second set of gripper mounts.

9. A variable format signature collection apparatus comprising:

a sprocket; and a timing belt traveling about the sprocket, the timing belt including a plurality of gripper mounts the gripper mounts including a first set of gripper mounts arranged on the timing belt to support grippers for receiving first signatures of a first cutoff length and a second set of gripper mounts positioned to support grippers for receiving second signatures of a second cutoff length, wherein the gripper mounting positions include a third set of gripper mounting positions arranged on the timing belt to support grippers for receiving third signatures of a third cutoff length.

10. The variable format signature collection apparatus recited in claim 8 wherein the timing belt includes timing belt teeth and the sprocket includes sprocket teeth, the timing belt teeth interacting with the sprocket teeth during operation.

11. The variable format signature collection apparatus recited in claim 9 wherein the gripper mounting positions of the first set of mounting positions are evenly spaced about the timing belt and are on the teeth of the timing belt and the gripper mounting positions of the second set of mounting positions are evenly spaced about the timing belt and are on the teeth of the timing belt.

12. A method of collecting signatures of variable cutoff length in a printing press comprising the steps of:

providing a plurality of grippers;

arranging a first set of grippers from the plurality of grippers on a timing belt so that the first set of grippers are evenly spaced in a first arrangement about the timing belt;

gripping first signatures of a first cutoff length with the first set of grippers spaced in the first arrangement;

arranging a second set of grippers from the plurality of grippers on the timing belt so that the second set of grippers are evenly spaced in a second arrangement about the timing belt;

gripping second signatures of a second cutoff length with the second set of grippers spaced in the second arrangement; and translating the timing belt at a first velocity as the first set of grippers grip the first signatures and translating the timing belt at a second velocity as the second set of grippers grip the second signatures.

13. A method of collecting signatures of variable cutoff length in a printing press comprising the steps of:

providing plurality of grippers;

arranging a first set of grippers from the plurality of grippers on a timing belt so that the first set of grippers are evenly spaced in a first arrangement about the timing belt;

gripping first signatures of a first cutoff length with the first set of grippers spaced in the first arrangement;

arranging a second set of grippers from the plurality of grippers on the timing belt so that the second set of grippers are evenly spaced in a second arrangement about the timing belt; and gripping second signatures of a second cutoff length with the second set of grippers spaced in the second arrangement, wherein the first set of grippers includes a different amount of grippers than the second set of grippers.

14. A method of collecting signatures of variable cutoff length in a printing press comprising the steps of:

providing a plurality of grippers;

arranging a first set of grippers from the plurality of grippers on a timing belt so that the first set of grippers are evenly spaced in a first arrangement about the timing belt;

gripping first signatures of a first cutoff length with the first set of grippers spaced in the first arrangement;

arranging a second set of grippers from the plurality of grippers on the timing belt so that the second set of grippers are evenly spaced in a second arrangement about the timing belt; and gripping second signatures of a second cutoff length with the second set of grippers spaced in the second arrangement, wherein at least one of the grippers of the first set of grippers is one of the grippers of the second set of grippers.

15. The method recited in claim 12 wherein the first arrangement varies from the second arrangement and the first cutoff length varies from the second cutoff length.

16. A method of collecting signatures of variable cutoff length in a printing press comprising the steps of:

providing a plurality of grippers;

arranging a first set of grippers from the plurality of grippers on a timing belt so that the first set of grippers are evenly spaced in a first arrangement about the timing belt;

gripping first signatures of a first cutoff length with the first set of grippers spaced in the first arrangement;

arranging a second set of grippers from the plurality of grippers on the timing belt so that the second set of grippers are evenly spaced in a second arrangement about the timing belt;

gripping second signatures of a second cutoff length with the second set of grippers spaced in the second arrangement; and removing at least one gripper of the first set of grippers from the timing belt before arranging the second set of grippers on the timing belt.

17. The method recited in claim 16 further comprising leaving at least one gripper of the first set of grippers in place on the timing belt when the at least one gripper of the first, set of grippers is removed from the timing belt.

* * * * *